United States Patent [19]

Batts

[11] 4,034,903

[45] July 12, 1977

[54] HANGER FOR ARTICLE DISPLAY

[75] Inventor: John H. Batts, Grand Rapids, Mich.

[73] Assignee: John Thomas Batts, Inc., Zeeland, Mich.

[21] Appl. No.: 646,189

[22] Filed: Jan. 2, 1976

[51] Int. Cl.[2] ..... A47J 51/14

[52] U.S. Cl. ..... 223/96; 24/84 H; 24/251

[58] Field of Search ..... 223/91, 92, 93, 94, 223/95, 96; 211/113, 89, 124, 45, 46, 47, 48; 248/316 D; 24/84 R, 84 H, 251

[56] References Cited

U.S. PATENT DOCUMENTS

| | | | |
|---|---|---|---|
| 1,447,083 | 2/1923 | Jonas | 223/96 |
| 1,756,221 | 4/1930 | Staley | 223/91 |
| 2,483,303 | 9/1949 | Rysick | 223/96 X |
| 2,781,157 | 2/1957 | Schoch | 223/94 |
| 3,067,917 | 12/1962 | Reller et al. | 223/93 X |
| 3,767,092 | 10/1973 | Garrison et al. | 223/96 |

FOREIGN PATENT DOCUMENTS

| | | | |
|---|---|---|---|
| 740,306 | 11/1955 | United Kingdom | 223/91 |

*Primary Examiner*—George H. Krizmanich
*Attorney, Agent, or Firm*—Price, Heneveld, Huizenga & Cooper

[57] ABSTRACT

A suspended article display hanger arrangement includes an elongated, rigid bar upon which are slidably mounted a plurality of article engaging clamps. In the preferred embodiment, the clamps are divided into two sets, with one set permitting suspension of articles from the front surface of the bar and the other set permitting suspension of articles from the rear surface of the bar. The slidable mounting arrangement for the clamps is such that clamps from the first set may be positionable in a back-to-back relationship with clamps of the second set.

14 Claims, 6 Drawing Figures

HANGER FOR ARTICLE DISPLAY

BACKGROUND OF THE INVENTION

This invention relates to article display devices and, more particularly, to suspended, hanger-type article display arrangements.

In the display of a wide variety of articles for sales purposes, it is highly desirable that the range of designs, colors, or shapes of each article are positioned for comparison by the customer. For example, in the display of carpet samples, retailers prefer to present carpet samples of the same design but of various colors in such a manner that the customer may readily view simultaneously the contrast between several samples. Also, for comparison purposes, samples of different designs but of the same color or different colors should also be displayed together. Such display procedures permit the customer to readily compare different samples of the article and, therefore, increase the ease with which he can make his subjective selection.

Such display techniques are also applicable to the marketing of various fabric designs, wallpaper designs, multi/or different color vinyls, garments, hardboard, and other such articles. In fact, such display arrangements are desirable for marketing any article which is available in a variety of designs and/or colors.

Heretofore, various hook suspended hanger arrangements have been available for the display of carpet samples, garments, fabrics and the like. These hanger arrangements have generally taken the form of a rigid, elongate body secured to a support hook and having a pair of clamp-like members positioned on the body. An example of one such arrangement may be found in commonly owned U.S. Pat. No. 3,767,092 to Garrison et al, entitled GARMENT CLAMPING HANGER WITH SLIDABLE LOCKING CLIPS and issued Oct. 23, 1973.

The arrangement disclosed in the aforementioned patent is designed primarily for the suspension of garments. The clamp-like members are formed integral with or fixedly secured to opposite ends of a transversely extending body. This arrangement is primarily adapted to the display of a single article. Multiple articles are not readily suspended from the hanger since the clamp members are fixedly positioned to the body and only a pair of clamps are provided.

Other arrangements are also known wherein a pair of clamping members are slidably positioned along the transverse rigid body. The clamping members are so mounted primarily to accommodate articles having a different transverse dimension, such as different styles of pants.

With all of these prior arrangements, the user is unable to readily display samples of different designs or colors which also have different transverse dimensions. Since only a pair of clamps are provided, each clamp must support or engage each of the samples. Due to the usually limited clamping force provided by the clamping members, the number of samples displayed, due primarily to their combined weight, is necessarily limited. Also, when samples are suspended which have different transverse dimensions, the clamps must generally be positioned to match the dimension of the smallest article. As a result, the number of possible arangements and size of the articles to be displayed is correspondingly reduced. If the clamps are positioned to fully engage the article having the smallest transverse dimension, the larger article will not be supported at one corner. As a result, the corner will flop over and a totally unsatisfactory display is presented.

A need, therefore, exists for a relatively inexpensive hanger arrangement which is capable of supporting a plurality of different size samples in a front-to-back relationship whereby the proper comparison between the samples may be obtained.

SUMMARY OF THE INVENTION

In accordance with the present invention, a unique hanger for the display of various articles is provided by which the problems heretofore experienced are substantially alleviated. Essentially, the hanger for the display of articles includes an elongated, rigid bar having a generally rectangular cross section. A first set of article engaging clamps are slidably mounted on the bar and suspend articles from the front surface of the bar. In a preferred embodiment, a second set of article engaging clamps are also slidably mounted on the bar and are adapted to suspend articles from the rear surface of the bar. The number and positioning of the clamps may be varied to permit the display of a wide variety of different sized articles in a front-to-back relationship.

DETAILED DESCRIPTION OF THE PREFERRED EMBODIMENT

Figure 1:
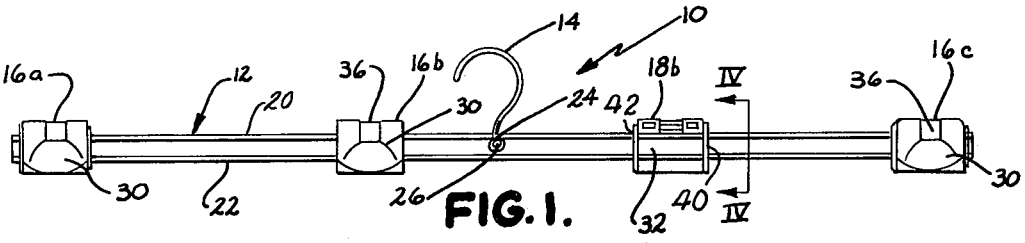
FIG. 1 is a front elevational view of the hanger in accordance with the present invention.
Figure 2:
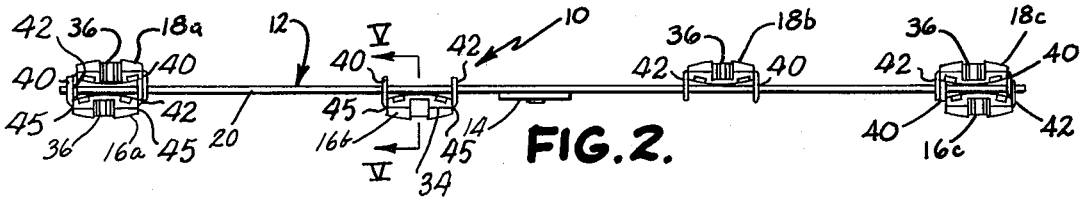
FIG. 2 is a top plan view of the hanger.

The unique hanger for the display of articles in accordance with the present invention is illustrated in the drawings and generally designated 10. As best seen in FIGS. 1 and 2, the hanger 10 includes an elongated, rigid bar 12, a suspension hook 14, a first set of holding clamps 16*a*, 16*b*, 16*c* and a second set of holding clamps 18*a*, 18*b*, 18*c*.

Figure 3:
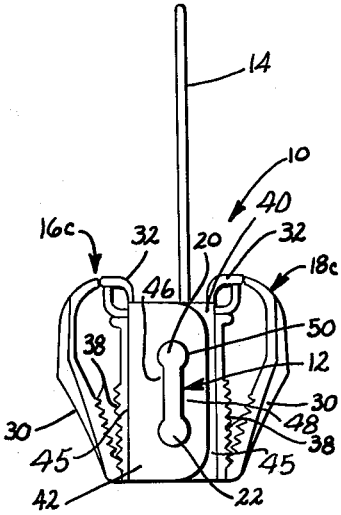
FIG. 3 is a side elevational view of the hanger.

The rigid bar 12 is illustrated as an elongated beam having a generally rectangular cross section. The beam 12 includes an upper reinforcing bead 20 and a lower reinforcing bead 22. The reinforcing beads extend longitudinally along the lateral edges of the beam and as best seen in FIG. 3, each bead has a generally circular cross section. The beads 20, 22 increase the resistance of the beam 12 to bending and thereby increase the load capacity of the hanger 10. This particular cross-sectional arrangement for the beam 12 has certain additional advantages relating to the mounting of the clamp members as will be more fully described below. It is considered desirable, to obtain an effective display, that the bar has a non-circular cross section so that off center loading of the hereafter described clamps will not result in their pivoting about the bar.

The hook 14 may be secured intermediate the ends of the beam 12 by a variety of arrangements. If the hook 14 and the beam 12 are formed as separate members, the hook may include an eye 24 at its lower end. A conventional rivet-type fastener 26 may then be employed to secure the hook to the beam. When the hook is secured to the beam in this fashion, it may be pivoted through an angle of 90° so as to extend along the longitudinal axis of the beam. This feature reduces packaging and shipping requirements in that it permits a larger number of hangers to be packaged in a specified carton by reducing the area each hanger occupies. Also, this permits more compact storage of the hangers at the point of use.

While it is preferred that the rigid beam be formed from aluminum or an aluminum alloy by a conventional extruding process, the beam and the hook could be formed as separate or integral members from rigid plastic material in a conventional two-piece mold. It is considered that aluminum is a suitable material from the standpoint of manufacturing costs, ease of manufacture and the resulting load carrying capacity of the beam.

Figure 5:
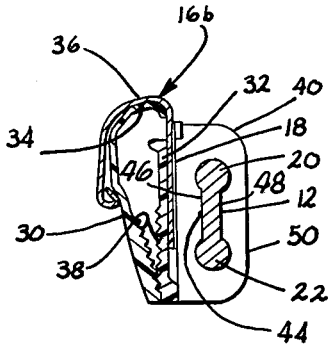
FIG. 5 is a cross-sectional, side elevational view taken generally along line V—V of FIG. 2.
Figure 4:
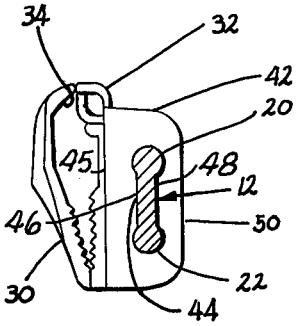
FIG. 4 is a cross-sectional, side elevational view taken generally along line IV—IV of FIG. 1.

As best seen in FIGS. 2, 4 and 5, each holding clamp of the first and second sets of clamps includes a front gripping member 30 and a rear gripping member 32. The gripping members 30, 32 are hingedly connected by a thin hinge or joining portion 34. A locking clip 36, having a generally U-shape, is provided to generate the compression holding force of the clamp members and also to lock the clamps in their closed position. The clamp members shown may be integrally molded from a suitable resinous plastic in a two-piece mold. The inner surface of member 30 and the outer surface of member 32 are preferably formed with outwardly extending projections 38. These projections provide additional gripping for holding the article securely between the clamp members. Other types of grip increasing means could be utilized.

The portion of the clamp, including the structural arrangement of the gripping members and the locking clip, are more fully described in the aforementioned, commonly owned U.S. Pat. No. 3,767,092 to Garrison et al, entitled GARMENT CLAMPING HANGER WITH SLIDABLE LOCKING CLAMP and issued on Oct. 23, 1973. Other forms of clamps may be employed with the present invention. For example, the clamp members disclosed in commonly owned U.S. Pat. No. 3,698,607 to Batts, entitled GARMENT CLAMPING HANGER and issued on Oct. 17, 1972 may be readily modified as will be more fully described below for use with the present invention.

Each holding clamp is slidably disposed on the beam 12 by a pair of longitudinally spaced, inwardly directed ears, wings or flanges 40, 42. The flanges 40, 42 extend generally perpendicular to the rear of the clamping member 32. Each flange includes an aperture 44 through which the beam 12 may be inserted. The flanges 40, 42 are preferably joined to the clamping member 32 along the vertical edges of the member. A simple, two-piece mold may then be employed to form a clamp with the flanges integral therewith and joined in a hinged fashion along a fold line 45 (FIGS. 2, 4 and 5).

With the preferred, bulbous beam construction including the reinforcing beads 20, 22 the apertures 44 include a centrally positioned slot and opposed circular areas to thereby define tabs 46, 48 which bear against the front and rear surfaces, respectively of the beam 12. The apertures 44 are preferably dimensioned somewhat smaller than the cross-sectional dimensions of the beam. As a result, sufficient frictional contact is provided between the tabs 46, 48 and the beam 12 so that any change in position in the clamps is resisted. This feature will prevent shifting of the clamps under the weight of the articles suspended therefrom. In order to provide this frictional, resisting force and in order that the clamps may be press fit onto the beam 12, it is preferred that the flanges 40, 42 be formed from a somewhat resilient, resinous material. A number of resinous materials may be used with polypropylene, polyethylene and certain types of nylon having been found to be particularly suitable. These materials develop the desired resilient stiffness and corresponding frictional force and are still highly resistant to fatique when the flanges are flexed as the clamps ar slidably moved along the beam 12. These materials are also suitable for the holding clamps. The ability to use the same material for the clamp members and flanges greatly simplifies manufacture. The clamp may be molded as a one-piece unit having suitable fold lines to hinge the clamp members and the flanges.

The circular cross section for the reinforcing beads, 20 and 22 and the corresponding configuration of the apertures 44 besides preventing rotation of the clamps about the longitudinal axis of the beam, also reduces the stress concentrations in the flanges and therefore increases the useful life of the clamps.

As best seen in FIGS. 2 and 3, the apertures 44 extend in a generally vertical direction and are positioned slightly off center from the vertical axis of each flange. In other words, the vertical centerline of the apertures 44 is positioned closer to the free edge 50 of each flange. This positioning of the aperture 44 permits the flanges of front and back mounted clamps to be interleaved and thereby positionable in a generally back-to-back fashion. As seen in FIGS. 2 and 3, the flange 40 of holding clamp **16*c* is positioned between the flanges 40, 42 of the holding clamp 18*c*. This interleafing permits limited longitudinal spacing between the holding clamps 16*c*, 18*c*** also permits the clamps to be positioned in an approximately back-to-back relationship. As will be more fully described below, this interleafing feature greatly increases the flexibility of use of the hanger.

Figure 6:
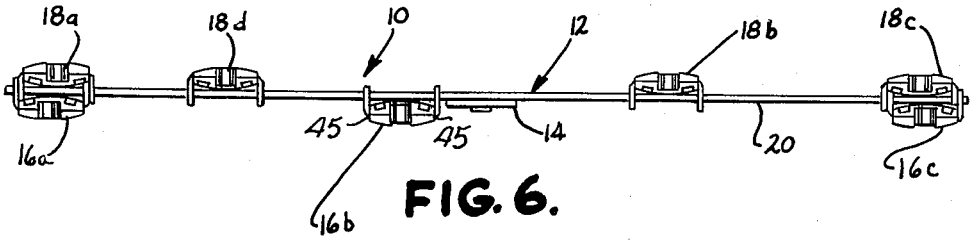
FIG. 6 is a plan view of a hanger similar to FIG. 2 but with the number of clamps increased.

When assembling the hanger, the particular number of holding clamps desired is determined and each is slipped onto the beam 12. When it is desired to interleaf a pair of holding clamps, the flange of one is positioned between the flanges of the other prior to positioning on the beam 12. As is readily apparent from FIGS. 2 and 6, the specific number of clamps employed in each set of holding clamps may readily be varied. For example, the hanger in FIG. 2 includes three clamps **16*a*, 16*b* and 16*c* on its forward or front set and three clamps 18*a*, 18*b*, 18*c* on its rear set. The hanger of FIG. 6, however, includes an additional clamp 18*d*** in its rear set of clamps.

With the present invention, an almost unlimited number of display arrangements are obtainable. For example, a carpet sample may be extended between the clamps **18*a*, 18*c* with the design facing forwardly. A second sample may be positioned between clamps 18*a* and 18*b* and also facing towards the front. A third carpet sample may be positioned between the clamps 16*a*, 16*b* of the front set and a fourth may be positioned between 16*b* and 16*c***. By employing samples having varying lengths, the full impact of the different designs or colors may be presented to the customer. In a similar fashion, a wide variety of differently dimensioned samples may be positioned on the clamps of the hanger shown in FIG. 6. By forming the holding clamps from a somewhat resilient, resinous material as described above, when a carpet sample or other article to be displayed is suspended between widely spaced clamps such as 18*a*, 18*c*, the weight of the article will not cause the clamps to be pulled inwardly towards each other, the frictional force being sufficient to prevent this movement. Therefore, the present invention permits the display of a large number of articles of different size and weight. At the same time, it permits the clamps to be used to effect lateral spreading of the article to assure full display. These features, coupled with the ability to reposition and/or add additional holding clamps to the beam, greatly increases the versatility of the hanger in the display of articles.

It will be recognized that while the preferred embodiment describes the device as being suspended from a hook, other types of suspension can be used including chains or wires. In fact, more than one suspension means can be used for each device.

The invention provides a simple device for hanging numerous types of large or heavy articles such as carpet samples and other floor covering samples. The invention provides a display device on which articles can be secured or from which they can be removed quickly and with a minimum of effort. Further, the attachment means will not mar or adversely affect most articles. The adjustability in spacing of the clamps offers many advantages both in making it possible to display articles of various sizes, or multiple articles in side-by-side relationship on one side, and in displaying articles of different sizes and even of different types on opposite sides of the bar.

Upon reading the above description, various modifications to the structure as illustrated will undoubtedly become apparent to those of ordinary skill in the art. For example, as previously discussed, various alternative forms of holding clamps may be employed without departing from the scope of the present invention. It is expressly intended, therefore, that the above description be considered as that of the preferred embodiment only. The true spirit and scope of the present invention will be determined by reference to the appended claims.

The embodiments of the invention in which an exclusive property or privilege is claimed are defined as follows:

1. A hanger for the display of articles, comprising:
an elongated, rigid bar of non-circular cross section;
a first set of article engaging means slidably and non-pivotally mounted on said bar for gripping and suspending articles from the front surface of said bar;
a second set of article engaging means slidably and non-pivotally mounted on said bar for gripping and suspending articles from the rear surface of said bar; and
wherein at least one article engaging means of said first set of engaging means is slidably positionable in a generally back-to-back relationship with at least one of said article engaging means of said second set.

2. A hanger as defined by claim 1 wherein said elongated rigid bar comprises:
a generally rectangular beam having a width greater than its thickness.

3. A hanger as defined by claim 2 wherein said beam further includes a first reinforcing bead extending longitudinally along one lateral edge thereof.

4. A hanger as defined by claim 3 wherein said beam further includes a second reinforcing bead extending longitudinally along the other lateral edge thereof, said first and said second reinforcing beads having a generally circular cross section.

5. A hanger as defined by claim 4, further including a support hook pivotally secured to said beam intermediate the ends of said beam.

6. A hanger comprising an elongated, rigid, generally rectangular beam;
a first set of article gripping means slidably mounted on said beam for suspending articles from a front surface of said beam;
a second set of article gripping means slidably mounted on said beam for suspending articles from the rear surface of said beam, at least one of said second set of gripping means movable to a position generally back-to-back with at least one of said article gripping means of said first set; and
wherein each article engaging means comprises:
a pair of hinged gripping members;
a flange extending rearwardly from one of said hinged gripping members, said flange having an aperture therein dimensioned so as to be slidably positionable over said elongated rigid beam and to frictionally engage said rigid beam.

7. A hanger as defined by claim 6 wherein each of said article gripping means further includes:
an additional rearwardly extending flange connected to said one gripping member, said flange and said additional flange being longitudinally spaced with respect to each other, said additional flange also having an apperture dimensioned so as to be slidably positionable on said elongated beam.

8. A hanger as defined by claim 7 wherein said apertures of each of said flanges extend in a generally vertical direction through said flanges and said apertures are positioned closer to the free edge of said flanges so that said flanges may be interleafed on said beam.

9. A hanger comprising an elongated, rigid, generally rectangular beam;
a first set of article gripping means slidably mounted on said beam for suspending articles from a front surface of said beam;
a second set of article gripping means slidably mounted on said beam for suspending articles from the rear surface of said beam;
each article engaging means comprising:
a pair of hinged gripping members;
a flange extending rearwardly from one of said hinged gripping members, said flange having an aperture therein dimensioned so as to be slidably positionable over said elongated rigid beam; each of said article gripping means further including:
an additional rearwardly extending flange connected to said one gripping member, said flange and said additional flange being longitudinally spaced with respect to each other, said additional flange also having an aperture dimensioned so as to be slidably positionable on said elongated beam; and
wherein the flanges of at least one of said article gripping means of said first set and the flanges of at least one of said article engaging means of said second set are interleaved whereby said corresponding gripping means are slidably positionable in a back-to-back relationship.

10. A hanger as defined by claim 9 wherein said beam is an elongated, rigid beam having a generally rectangular cross section and further includes upper and lower longitudinally extending reinforcing beads.

11. A hanger as defined by claim 10 wherein said reinforcing beads of said beam have a generally circular cross section and wherein each of said flanges is resilient and each of said apertures are dimensioned to define tabs that frictionally engage said beam.

12. A hanger for the display of articles, comprising:

an elongated, rigid bar of non-circular cross section;

a plurality of article engaging means each having article clamping elements;

a support member on said article engaging means extending normal to said means and said bar and having an opening therethrough for slidably receiving said bar and supporting said means on one side of said bar, said opening being of a size and shape to seat snugly around said bar and hold said article engaging means against rotation with respect to said bar.

13. A hanger for the display of articles as described in claim 12 wherein a pair of said support members are provided, said members being spaced apart for holding said article engaging means against pivoting in a plane parallel to the longitudinal axis of said bar.

14. An article engaging and support means slidable on an elongated bar of an article display device, said means comprising: a body member having a rear clamping member and a front clamping member and a hinge portion pivotally joining said members together along the top whereby said front clamping member may be pivotally moved from a position in the same plane as said rear member toward and away from said rear member, the improvement in said means comprising a pair of wing members, one at each side edge of said rear clamping member, each of said wing members having an opening therethrough offset towards the free edge of said wing member opposite said side edge of said clamping member and dimensioned to slide on said elongated bar and being pivotally secured to said rear clamping member for folding from a position in which it is in the same general plane as said rear clamping member to a position in which it extends rearwardly generally normal to said rear member and when so folded the openings in both of said wings are aligned along an axis extending parallel to said plane of said rear clamping member whereby said means can be molded as a single, integral flat article with all portions generally in a single common plane.

* * * * *